US007203994B2

(12) United States Patent
Smith

(10) Patent No.: US 7,203,994 B2
(45) Date of Patent: Apr. 17, 2007

(54) COMPRESSED AIR VACUUM CLEANER

(76) Inventor: Donald A. Smith, 2620 W. 1500 South, Vernal, UT (US) 84078

( * ) Notice: Subject to any disclaimer, the term of this patent is extended or adjusted under 35 U.S.C. 154(b) by 206 days.

(21) Appl. No.: 10/964,077

(22) Filed: Oct. 13, 2004

(65) Prior Publication Data

US 2006/0032014 A1 Feb. 16, 2006

Related U.S. Application Data

(63) Continuation-in-part of application No. 10/817,166, filed on Apr. 1, 2004, which is a continuation-in-part of application No. 10/055,857, filed on Jan. 25, 2002, now Pat. No. 6,826,799.

(51) Int. Cl.
*A47L 5/16* (2006.01)
*A47L 5/18* (2006.01)

(52) U.S. Cl. ..... 15/409; 15/353

(58) Field of Classification Search ..... 15/321, 15/322, 323, 353, 408, 409; 222/559, 560, 222/561

See application file for complete search history.

(56) References Cited

U.S. PATENT DOCUMENTS 1,986,476 A * 1/1935 Ironside ..... 141/28
2,272,912 A * 2/1942 Heinkel ..... 210/539
2,652,177 A * 9/1953 Lagemann ..... 222/509
2,863,525 A * 12/1958 Lucian ..... 55/334
2,867,835 A * 1/1959 Brown, Jr. et al. ..... 15/328
3,452,751 A * 7/1969 Austin, Jr. ..... 604/149
3,971,096 A * 7/1976 Renholt ..... 15/326
4,915,245 A 4/1990 Wouters et al.
5,142,730 A * 9/1992 Braks et al. ..... 15/327.5
5,867,865 A 2/1999 Obermuller et al.

(Continued)

FOREIGN PATENT DOCUMENTS

DE 2521350 * 11/1976
RU 2135065 * 8/1999

OTHER PUBLICATIONS

Sump-N-Ator Sump Vacuum, Model #2108, www.industrial-vacuum-cleaner.com, web page advertisement Sep. 15, 2004.

(Continued)

*Primary Examiner*—Terrence R. Till
(74) *Attorney, Agent, or Firm*—Thorpe North & Western, LLP

(57) ABSTRACT

A vacuum cleaner powered by compressed air includes a canister forming an internal collection chamber. The vacuum cleaner includes a drain at the bottom of the collection chamber from which liquid and debris can be drained, and may also provide for pressurizing the collection chamber for forcing collected liquid from the drain to a liquid drain or collecting drum or tank. This makes draining the collection chamber easier than in other vacuum cleaners. Preferably the bottom of the chamber slopes toward the drain. The chamber may be pressurized by the compressed air used to power the vacuum cleaner. The vacuum cleaner may also include a separate pressure tank for holding a degreaser, detergent, or soap which can be sprayed onto the residue of a liquid spill afier the liquid has been sucked up. The vacuum cleaner may includes wheels and a handle for easy movement.

29 Claims, 7 Drawing Sheets

U.S. PATENT DOCUMENTS

Figure 1:
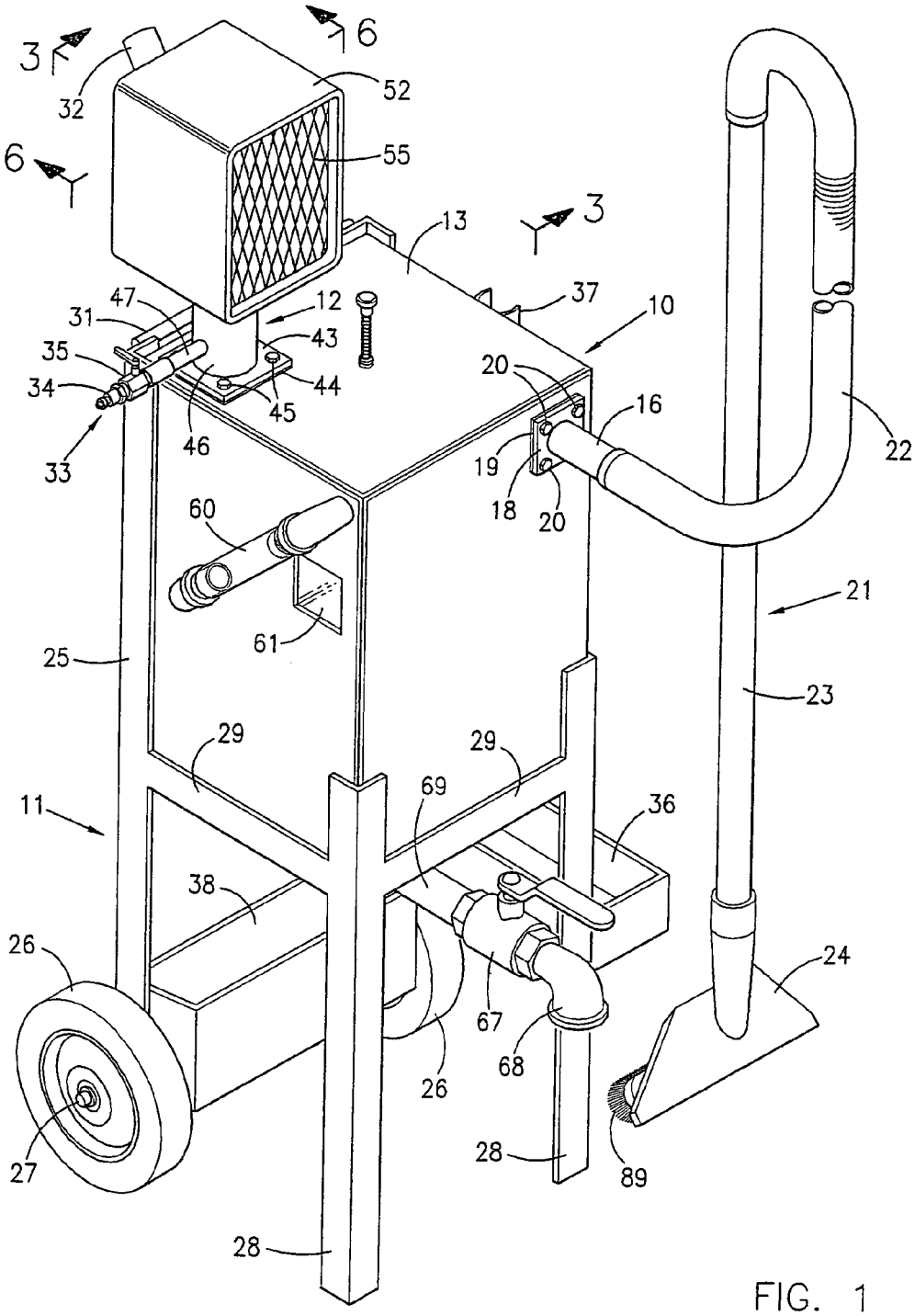

| | | | | |
|---|---|---|---|---|
| 6,049,941 | A | 4/2000 | Vollenweider, II | |
| 6,338,750 | B1 | 1/2002 | Lorini | |
| 2002/0116783 | A1 * | 8/2002 | Giddings et al. | 15/321 |

OTHER PUBLICATIONS

NIKRO Industries, AWP15150, www.industrial-vacuum-cleaner.com, web page advertisement Sep. 15, 2004.

NIKRO Industries, Compressed Air Venturi Series of Vacuums, www.industrial-vacuum-cleaner.com, web page advertisement Sep. 15, 2004.

XtractMax® Compressed Air Vacuums, Pulse Jet Series, www.industrial-vacuum-cleaner.com, web page advertisement Sep. 15, 2004.

Hand-D-Vac, Hendheld Industrial Vacuum, www.industrial-vacuum-cleaner.com, web page advertisement Sep. 15, 2004.

Jordan Power Equipment Co., DWD Air Powered Vac, www.jordan power.com, web page advertisement Aug. 2, 2004.

Jordan Power Equipment Co., Industrial Vacs, CFM Oil Vacuum, www.jordan power.com, web page advertisement Aug. 2, 2004.

* cited by examiner

COMPRESSED AIR VACUUM CLEANER

RELATED APPLICATION

This is a continuation-in-part of copending application Ser. No. 10/817,166, filed Apr. 1, 2004, and entitled "Compressed Air Vacuum," which was a continuation-in-part of application Ser. No. 10/055,857, filed Jan. 25, 2002, now U.S. Pat. No. 6,826,799 and entitled "Compressed Air Vacuum."

BACKGROUND OF THE INVENTION

1. Field

The invention is in the field of vacuum cleaners that operate on compressed air.

2. State of the Art

Vacuum cleaners that operate on compressed air are known, see for example U.S. Pat. Nos. 2,863,525 and 5,142,730. Such vacuum cleaners operate from a source of compressed air such as available in many factories and garages. Electrical connection is unnecessary and the risk of electrical sparking is eliminated. Further, such vacuum cleaners can produce high air flow and, as opposed to most electrical vacuums, the vacuum produced is increased as the flow of air into the vacuum is reduced. Such vacuums have been found particularly useful in industrial applications for liquid spill pickup. The inventor has found that such vacuums are particularly useful in automobile repair stations and shops where spills of oil, transmission fluid, antifreeze, gasoline, water, etc., occur during auto and truck repair.

The vacuum cleaners of the indicated patents include canisters that fill up with dirt or liquid. The canister of U.S. Pat. No. 2,863,525 has a hinged bottom that can be opened to empty the canister while U.S. Pat. No. 5,142,730 says that the canister can be emptied, but no way of emptying it is shown or described.

Several models of compressed air vacuum cleaners are manufactured and sold by IAS Industrial Vacuums of Cornelius, N.C. These vacuums use canisters, such as fifteen to fifty five gallon drums, for collection of dirt or liquids picked up by the vacuum. It appears that these are emptied from the top by removing the vacuum generating apparatus, which is located over the open top of the drum. A model called the Sump-N-Ator sump vacuum, Model 2108, is designed to pick up liquid and then can pump the collected liquid from the drum. However, the liquid exits the top of the drum with a pipe extending toward the bottom portion of the drum to pick up the liquid, which allows solids to build up in the bottom of the drum. This vacuum cleaner includes a filter to filter and collect solid particles from the liquid entering the chamber. The filter keeps larger solid particles from building up on the bottom of the drum although sludge can still build up. Further, the filter has to be changed when filled.

None of the vacuum cleaners have a convenient system of emptying the canister and preventing build up of material on the bottom of the canister. Further, while some of these vacuum cleaners are supported on wheeled drum dollies, these can still be difficult to move around.

SUMMARY OF THE INVENTION

According to the invention, a compressed air vacuum cleaner having a canister with an internal collection chamber includes a drain at the bottom of the chamber from which the liquid and debris collected in the chamber can be drained. The vacuum cleaner is designed primarily for cleaning up liquids, and when liquid is drained at the bottom of the chamber, the liquid carries with it particulate and other heavy and solid material that has built up on the bottom of the chamber. It is preferred that the drain opening extend through the bottom of the chamber and be located centrally of the bottom of the chamber, and that the bottom of the chamber be dish or pyramid shaped to aid in flow of heavy and solid collected material from the bottom. However, the drain opening may be located anywhere through the bottom or at a side of the bottom substantially aligned with the bottom. In such cases, the bottom can slope toward the drain opening, but does not have to. Locating the drain opening at the bottom of the chamber makes draining the collection chamber much easier that in other vacuum cleaners. A further feature of the vacuum cleaner of the invention is that the collected liquid may be forced from the bottom of the chamber by pressurizing the chamber. This can conveniently be done using the compressed air which is normally used to create the vacuum in the chamber. Forcing the liquid from the chamber allows the liquid to flow through a drain hose to a waste storage or disposal location at a distance from the vacuum cleaner or at a location above the vacuum cleaner. The vacuum cleaner may also be built similarly to a wheeled cart, such as a hand truck, so the vacuum cleaner can be easily moved by a user. A storage tray for cleaning supplies or a tank for a cleaning agent may be included with the vacuum cleaner.

The preferred vacuum cleaner of the invention includes a canister having a top end, a bottom end, and an internal collection chamber. A venturi and nozzle assembly in fluid flow communication with the internal chamber through an air outlet is adapted to be connected to a source of compressed air whereby compressed air is directed from the nozzle through the venturi to create a vacuum in the internal collection chamber. An outlet to the atmosphere is provided for exhausting air passing through the venturi. A vacuum intake hose in fluid flow communication through an air inlet with the upper portion of the internal collection chamber is adapted to have a cleaning attachment secured thereto. The liquid and debris sucked into the internal collection chamber through the air inlet and intake hose from the cleaning attachment falls and collects in the bottom of the chamber as any air from the vacuum intake hose moves through the chamber between the air inlet and air outlet.

The collected liquid and debris is drained from the chamber through the drain at the bottom of the chamber when the drain is opened by the user. When the vacuum cleaner is built as a wheeled cart, the vacuum cleaner can be easily wheeled to a location where the drain opening is over an inlet to a waste collection reservoir or other disposal vessel and the drain opened by a user to drain the internal collection chamber. In one embodiment, the drain can be opened by the user from the top of the canister. In instances where the inlet to the waste collection reservoir is above floor level so the vacuum cleaner drain cannot be easily positioned over the inlet to the waste collection reservoir, a length of hose can be connected to the drain opening and the vacuum cleaner can include provision to pressurize the internal collection chamber to force liquid and debris through the drain hose when the drain is opened. The internal collection chamber can be pressurized by closing the air inlet to the chamber and by closing the outlet for exhausting air from the venturi. With the outlet for exhausting air from the venturi closed, the compressed air from the nozzle will not flow through the venturi to create a vacuum, but will instead flow into the collection chamber, and with the air inlet to the collection chamber closed, will pressurize the collection chamber. The pressure in the collection chamber will then force liquid and debris in the collection chamber out through the drain outlet when opened. When using a hose connected to the drain outlet, it is preferred that the hose include a valve at the end of the hose so a user can control flow from the chamber from the end of the hose.

An auxiliary tank which can also be pressurized from the compressed air supply can be mounted on the vacuum cleaner for holding a cleaning agent such as a degreaser, detergent, or soap. A hose and spray nozzle allows the cleaning agent from the pressurized auxiliary tank to be sprayed onto the residue of a spill to clean up the residue once the spill itself has been sucked up. A brush on the cleaning attachment can be used to scrub the cleaning agent into the residue which can then be sucked up into the vacuum cleaner. A tray can also be provided to hold containers of cleaning agents and a tray and clip can be provided to support and hold the cleaning attachment and vacuum intake hose when not in use.

THE DRAWINGS

Figure 2:
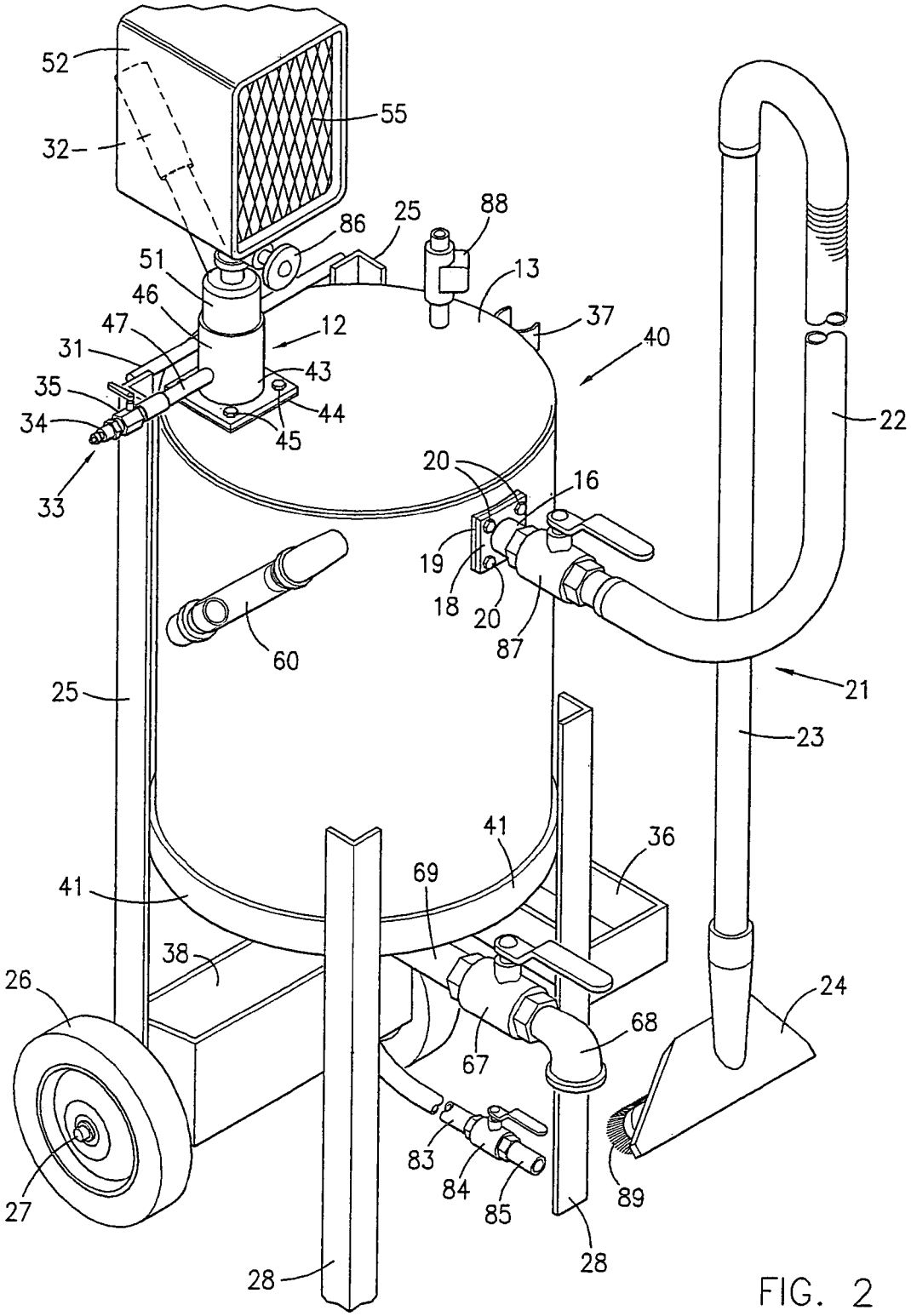
Figure 3:
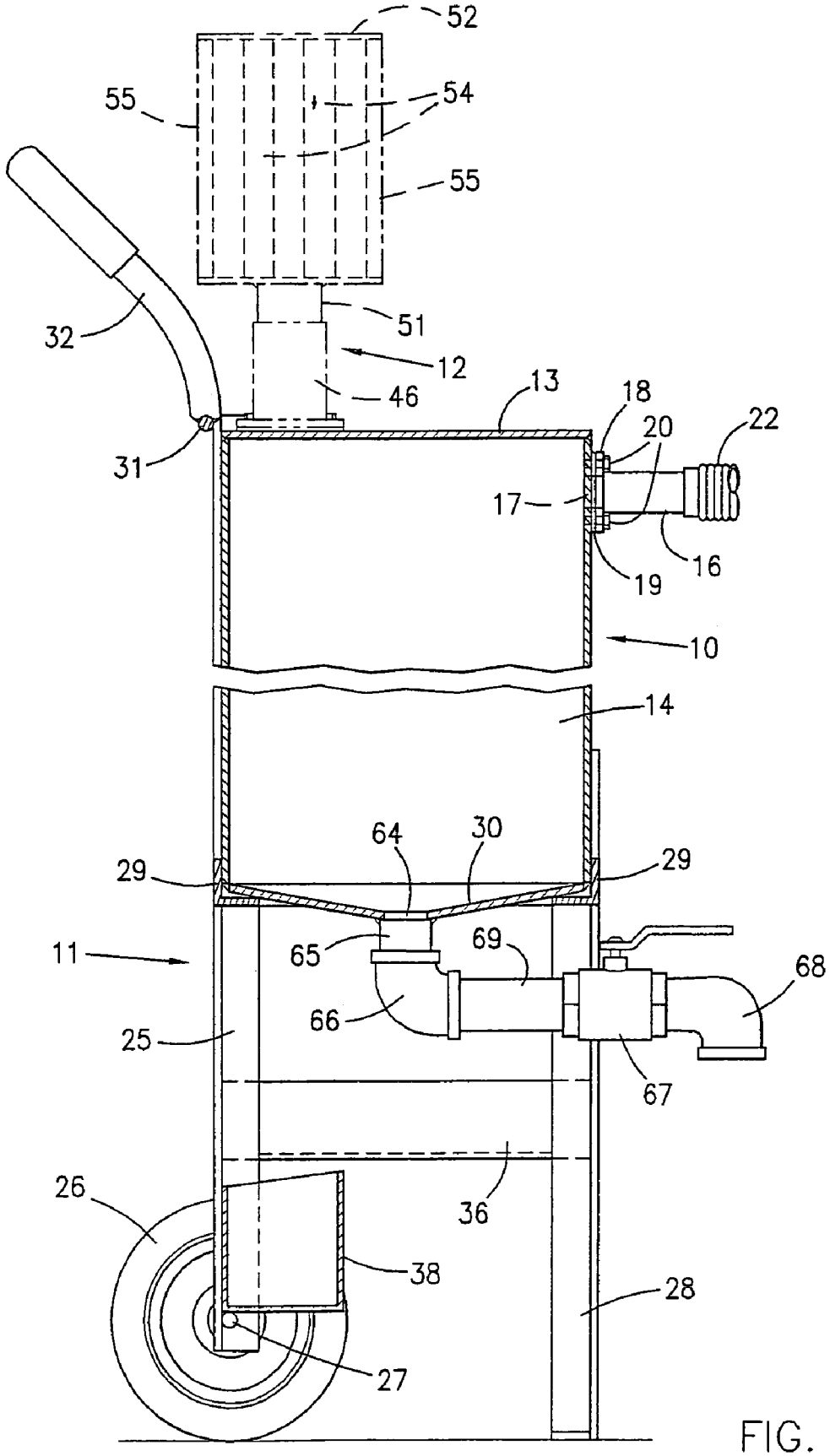
Figure 4:
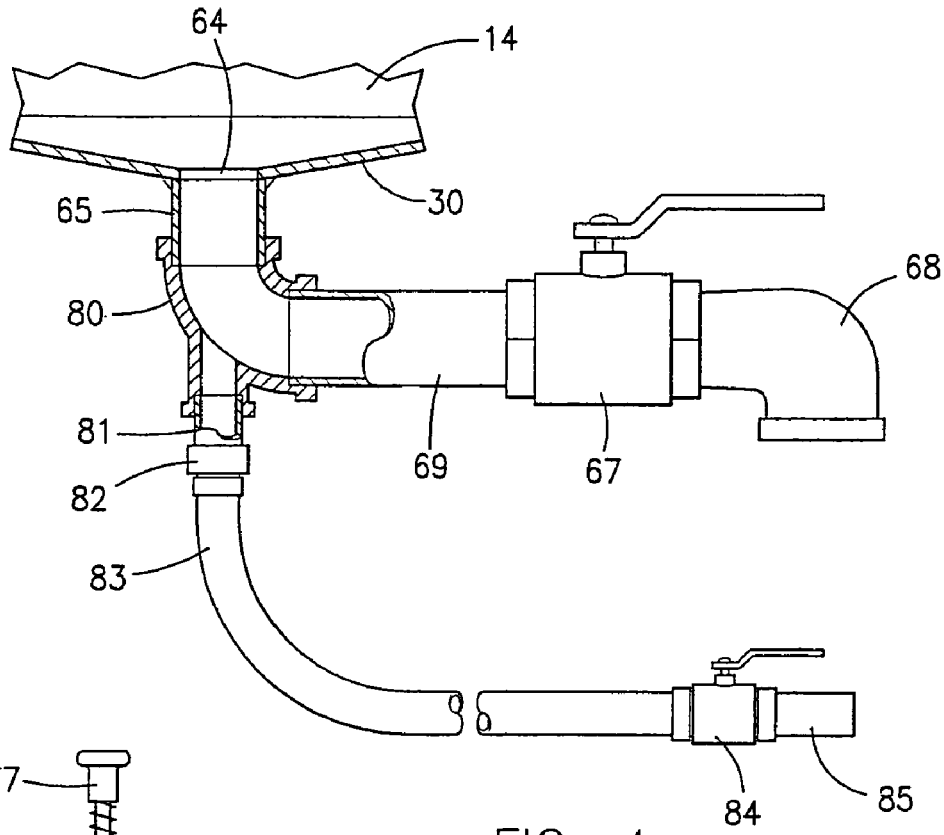
Figure 5:
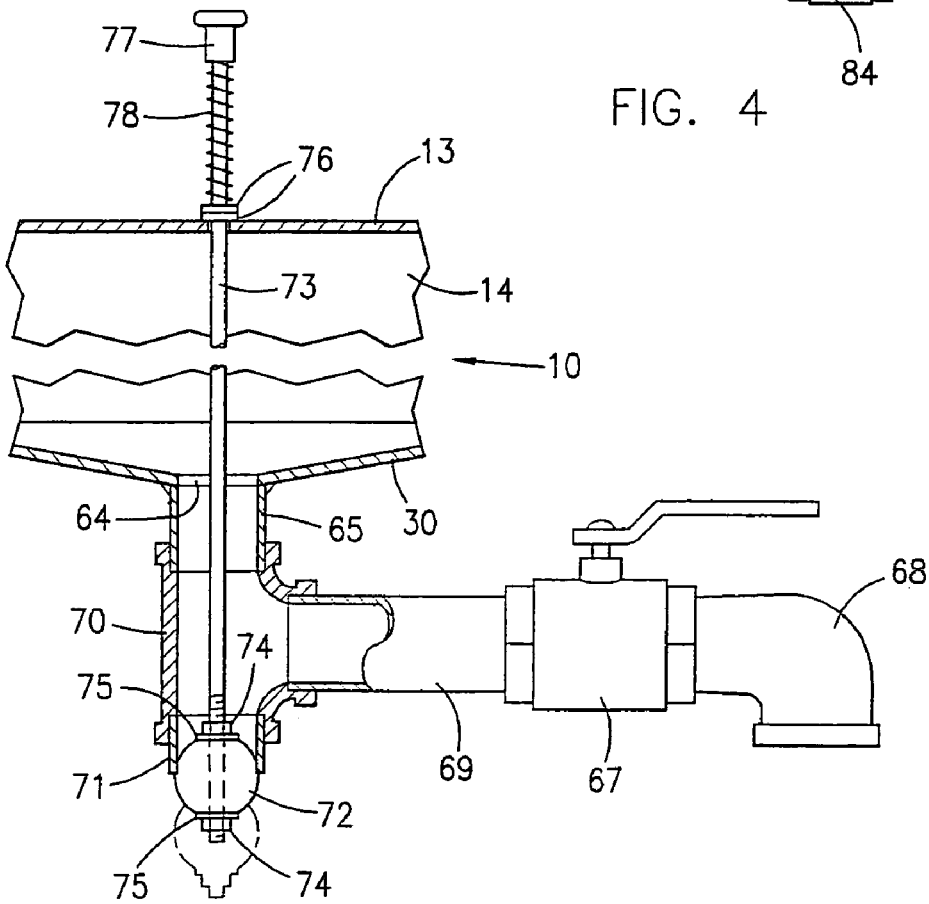
Figure 6:
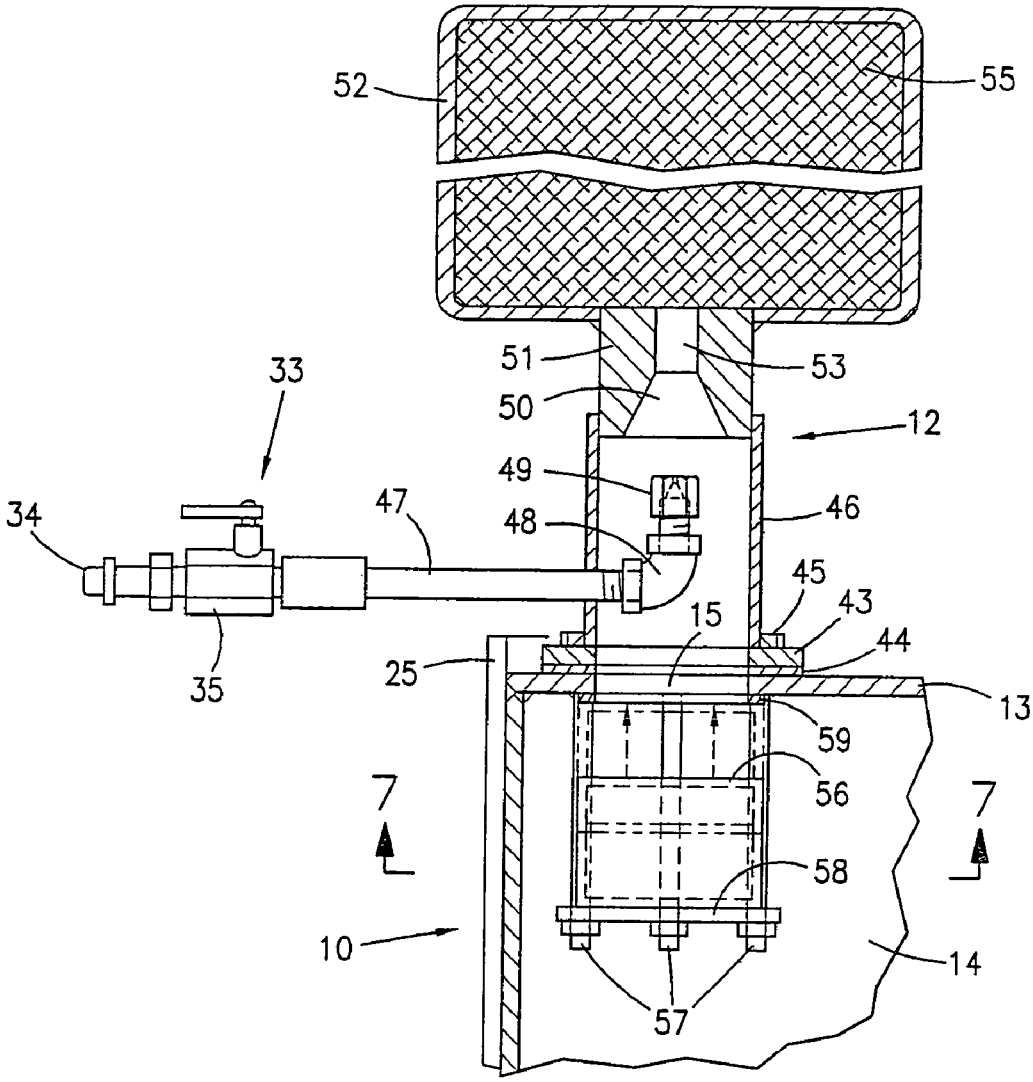
Figure 7:
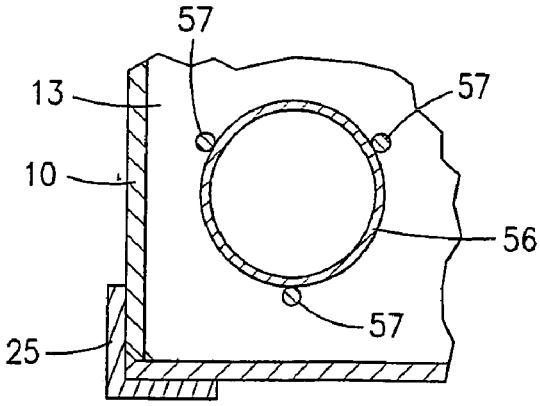
Figure 8:
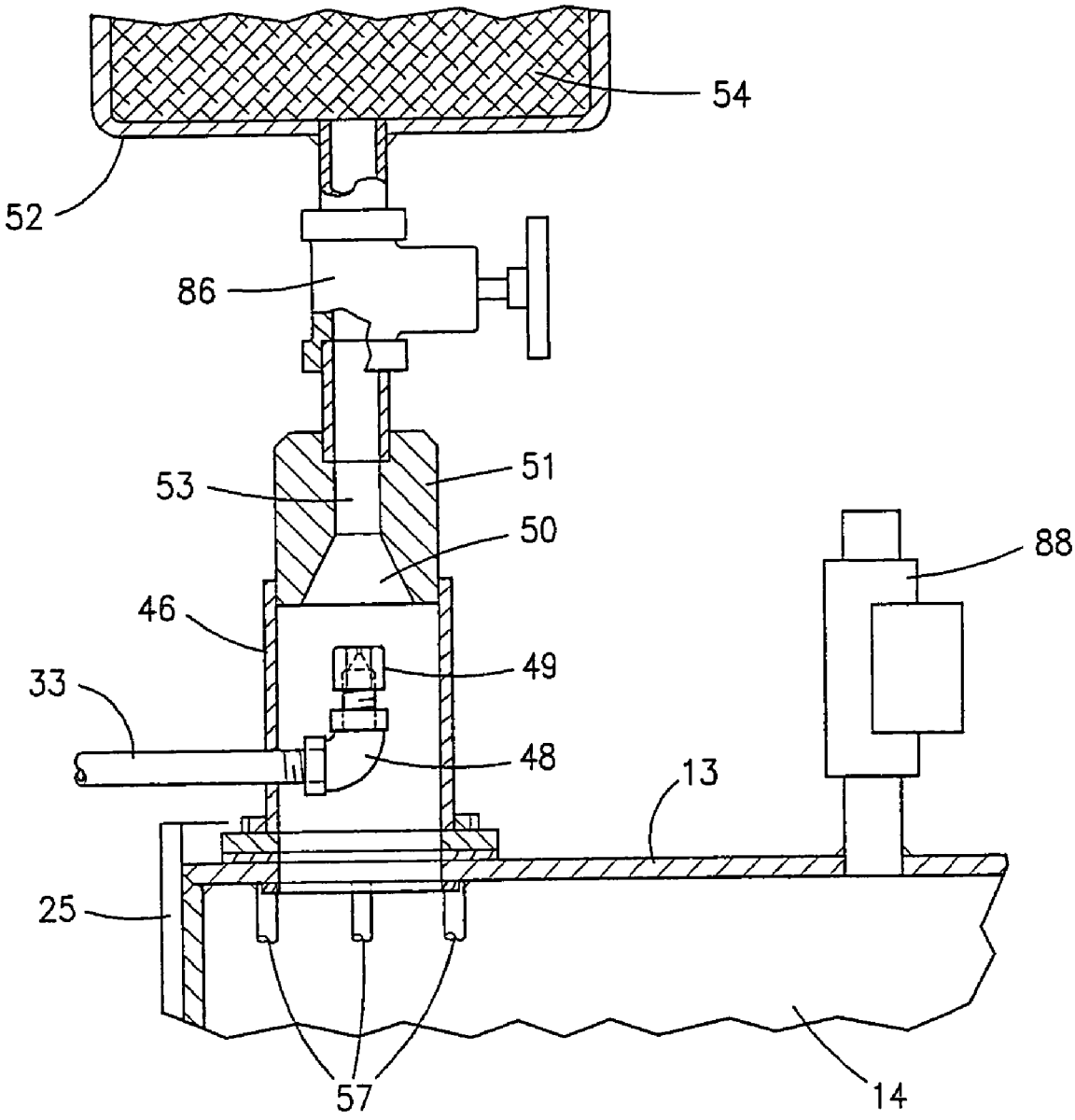
Figure 9:
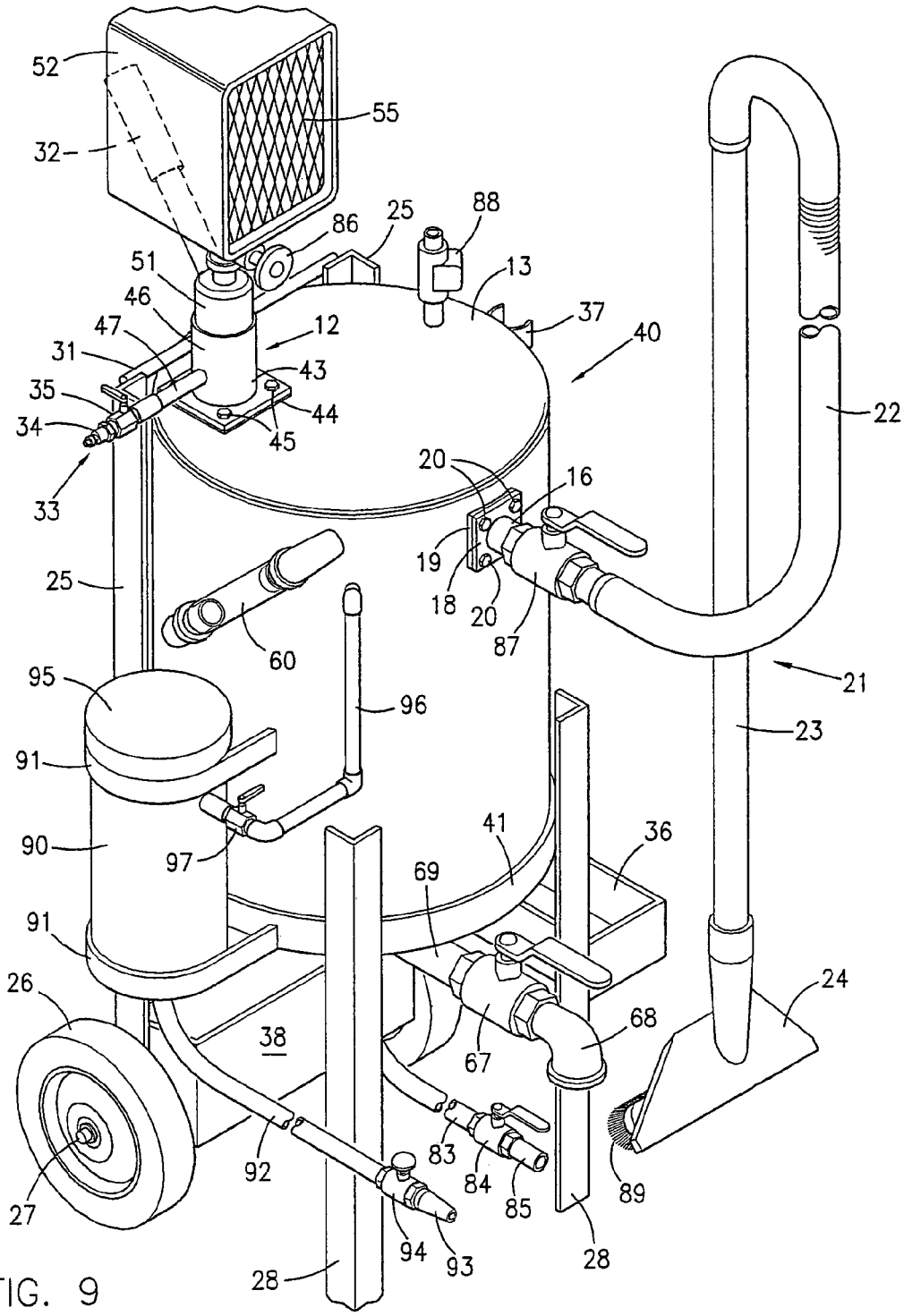

In the accompanying drawings, which show the best modes currently contemplated for carrying out the invention:

FIG. 1 is a pictorial view of a vacuum cleaner of the invention;

FIG. 2, a similar pictorial view showing a second embodiment of a vacuum cleaner of the invention;

FIG. 3, a vertical section taken on the line 3—3 of FIG. 1;

FIG. 4, an enlarged fragmentary side elevation, partially in section, of the bottom of the canister and drain of a vacuum cleaner of the invention as shown in FIG. 3, with an additional drain hose;

FIG. 5, an enlarged fragmentary vertical section, partially in elevation, of the bottom of the canister and drain of a vacuum cleaner of the invention showing a further embodiment of drain;

FIG. 6, an enlarged fragmentary vertical section, partially in elevation, of the nozzle and venturi and overflow protection valve;

FIG. 7, a transverse section taken on the line 7—7 of FIG. 6;

FIG. 8, an enlarged fragmentary vertical section, partially in elevation, of a further embodiment of the nozzle and venturi and showing a pressure relief valve; and FIG. 9, a pictorial view similar to that of FIG. 2, showing an auxiliary tank mounted on the vacuum cleaner.

DETAILED DESCRIPTION OF THE ILLUSTRATED EMBODIMENTS

The vacuum cleaner of the invention comprises a canister 10, FIGS. 1 and 3, preferably mounted on a two wheeled cart 11, similar to a hand truck, for easy movement by a user. The vacuum cleaner is powered by compressed air so has a nozzle and venturi assembly 12 mounted on the top 13 of the canister 10 and in fluid flow communication with canister internal chamber 14, FIGS. 3, 6, and 8, through a chamber outlet 15, FIGS. 6 and 8. A vacuum intake pipe connector 16, FIGS. 1 and 3, is mounted in fluid flow communication with canister internal chamber 14 through chamber inlet 17, FIG. 3, such as by flange 18 with gasket 19 and bolts 20, FIGS. 1 and 3. A vacuum intake pipe or hose 21 includes a flexible hose portion 22 extending from connector 16 and rigid handle portion 23, with a cleaning attachment 24 on the end thereof. The cleaning attachment 24 can be manipulated by a user holding the handle portion 23 so that the vacuum cleaner will suck up liquid or other material to be cleaned up. Cart 11 includes a pair of rear legs 25 with wheels 26 rotatably mounted on axle 27 secured to rear legs 25 and a pair of front legs 28. Legs 25 and 28 are joined together by horizontal connectors 29 which also serve as supports for the bottom 30 of canister 10, FIG. 3. Legs 25 and 28, and horizontal connectors 29 can conveniently be formed of angle irons as shown in FIGS. 1 and 3. Rear legs 25 extend upwardly to the top of canister 10 and are connected by connector 31 from which handle 32 extends. Thus, a user holding handle 32 can easily tip the vacuum onto its wheels 26 and move it to a desired location where it then stands on both its wheels 26 and front legs 28 while in use or storage between uses. In use, a source of compressed air is connected to the inlet 33, FIGS. 1, 6, and 8, of the nozzle and venturi assembly 12 through quick connect connector 34 and valve 35. A drip pan 36, FIG. 1, holds the end of the vacuum intake pipe or hose 21 and cleaning attachment 24 when not in use with handle portion 23 held by clip 37, FIG. 1, and a storage pan 38 can hold cleaning supplies such as containers of degreaser and detergent, not shown.

Canister 10 can be rectangular in shape as shown in FIG. 1, can be cylindrical in shape as shown by canister 40, FIG. 2, or other desired shapes. The horizontal connectors will be adapted for the shape of the canister, with horizontal connectors 29, FIGS. 1 and 6, supporting the rectangular canister 10, being straight, and horizontal connectors 41, FIG. 2, supporting the cylindrical canister 40, being arcuate. Otherwise, similar parts in FIGS. 1 and 2 are similarly numbered. It is preferred that chamber outlet 15 and chamber inlet 17 be at opposite sides of the canister, as shown, so that liquid and other debris from chamber inlet 17 have time to settle in chamber 14 rather than being drawn into chamber outlet 15.

As shown in FIGS. 1, 3, and 6, nozzle and venturi assembly 12 is mounted on top 13 of canister 10, such as by flange 43 with gasket 44 and bolts 45. A sleeve 46 supports pipe 47 extending from the sleeve with valve 35 and quick connect connector 34 at the end thereof secured by appropriate sleeves and nipples. A pipe elbow 48 located in sleeve 46 positions nozzle 49 to direct air toward venturi 50 formed by cylinder 51 supported in the upper end of sleeve 46. A filter housing 52 secured to the top of cylinder 51 in communication with venturi outlet 53, holds filter pads 54 which filter air leaving the vacuum cleaner and serve to muffle noise. Screens 55 at the open ends of filter housing 52 hold filter pads 54 in the housing 52 and allow air flow from the venturi outlet 53, through filter pads 54, to the atmosphere. Hog hair type filters pads, such as used in swamp coolers but cut to a size to fit into filter housing 52, have been found satisfactory.

An overflow prevention valve, FIGS. 6 and 7, is provided by float 56 held by rods 57 and bottom support 58. In normal position, float 56 rests on bottom support 58. If fluid fills chamber 14 above the level of support 58, float 56 will float on the liquid, guided by rods 57. As the liquid rises, so does float 56, until float 56 abuts gasket 59 at the canister top 13 to close chamber outlet 15, thereby blocking fluid flow through chamber outlet 15. A sight tube 60, FIG. 1, or sight window 61, may be provided in the canister to show when the level of fluid in the canister internal chamber 14 is approaching the top of the chamber and the chamber needs to be emptied. Float 56 may be provided in the form of a ball or other shape rather than the cylinder shown.

An inconvenience with most prior art vacuum cleaners is that the top of the canister has to be removed and the canister tipped over to empty the internal chamber where liquid and other debris collects. Where the bottom of the canister hinges open as in one prior art vacuum cleaner, the vacuum cleaner has to be held over a waste receptacle which can catch the mostly undirected rush of material from the canister when the bottom is opened. Where a tube extends from the top of the canister toward the bottom thereof for pumping liquid from the canister, or where a drain is provided on the side of the canister, above the bottom of the canister, debris and sludge builds up on the bottom of the canister and the canister still has to be opened at intervals to clean it. The vacuum cleaner of the invention includes a drain at the bottom of the canister, preferably through the bottom of the canister, to allow liquid to drain out from the bottom. During draining from the bottom, debris and sludge is carried with the draining liquid so it does not build up on the bottom. As shown in FIG. 3, canister bottom 30 is preferably sloped (such as pyramid shaped if the canister is rectangular and cone or bowl shaped if the canister is cylindrical) with drain opening 64 extending through bottom 29 to drain 65 at the lowest point. While it is presently preferred to locate drain opening 64 in the center of the chamber bottom, it could be located in different positions through the chamber bottom, or at the edge of the chamber bottom through the canister side substantially in line with the bottom. Again, it is preferred that the canister bottom slope toward the drain to increase the extent of liquid flow along the bottom to pick up heavy and solid debris and sludge from the bottom and carry it out through the drain as the liquid drains from the canister.

Various configurations of drains can be used. As shown in FIG. 3, an elbow 66 is secured to the bottom of drain 65 with valve 67 and outlet elbow 68 connected thereto by nipple 69. This places valve 67 where it can be more easily operated by a user of the vacuum cleaner than if it was located centrally under the canister. With this arrangement, when the canister is to be drained, it is moved so that the outlet of outlet elbow 68 is over a waste collection reservoir and valve 67 is opened to allow liquid along with other debris in the canister to drain into the reservoir. The flowing of the liquid over and along the bottom 30 of the canister will pick up debris and sludge settled on the bottom.

FIG. 5 shows an alternate drain arrangement. A tee 70 is provided on drain 65 rather than elbow 66. A drain nipple 71 is provided on the straight through end of tee 70 while the tee stem outlet has the same nipple 69, valve 67, outlet elbow 68 arrangement as previously described. This provides alternate drains. The open end of drain nipple 71 is closed by a plug in the form of a rubber or plastic sealing ball 72 biased to closed position as shown in solid lines in FIG. 5. Sealing ball 72 is secured to an end of rod 73 by nuts 74 and washers 75. Rod 73 extends through drain 65, canister 10, canister top 13, and sealing washers 76, has a handle 77 at the top end thereof, and is easily accessible to a user to operate from the top of the vacuum cleaner. A spring 78 between washers 76 and handle 77 biases rod 73 and ball 72 upwardly to the closed position and also bias sealing washers 76 against canister top 13. To drain the canister, the vacuum cleaner is moved so that ball 72 is over a waste collection reservoir, and handle 77 is depressed to open drain nipple 71 and allow liquid and other debris to flow out into the waste collection reservoir. This arrangement allows the drain to be easily opened from the top of the vacuum cleaner so a user does not have to bend over to operate valve 67.

The vacuum cleaner of the invention is particularly adapted for clean up of liquid spills in vehicle or other equipment service facilities where oil, transmission fluid, coolant, and other liquids may be spilled, or where such liquids may be drained from such equipment. With such liquids in such service facilities, it is common to collect the liquids in large drums or waste collecting tanks. Such waste collecting drums or tanks often do not have floor level inlets where the vacuum canister can be easily positioned over the inlet and drained through the vacuum cleaner drain outlets described above. The inlets to the waste collecting drums or tanks will generally be located above floor level. In such instances, it is convenient to be able to pump or force the liquid collected in the collection chamber through a hose to the inlet of the waste collecting drum or tank. For this purpose, the collection chamber 14 is pressurized and the liquid collected in the collection chamber 14 forced out of the chamber and through a hose to the collecting drum or tank. A hose can be connected to the outlet elbow 68 or to an outlet hose connector attached to valve 67 in place of outlet elbow 68. Alternatively, a separate outlet hose connection can be provided as shown in FIG. 4. In this embodiment, reducer tee 80 is secured to drain 65 with hose nipple 81 secured to the reduced tee end. A female hose end 82 of a length of hose 83 is secured to the hose nipple 81. Hose 83, FIGS. 2, 4, and 9, is long enough to extend from the vacuum cleaner to the inlet of the waste collecting drum or tank and includes a valve 84 at its end which can be opened or closed by a user to allow liquid to flow from hose 83 through outlet 85 into the waste collecting drum or tank.

In order to pressurize the chamber 14, a valve 86, FIGS. 2, 8, and 9, may be provided between the venturi outlet 53 and the filter housing 52, which can be closed to block flow of air through the venturi 50. This will cause the compressed air from the nozzle 49 to be diverted into chamber 14 since it cannot flow through venturi 50. A valve 87 in vacuum intake pipe connector 16 can be closed to block flow of the compressed air out of chamber 14 through the vacuum intake pipe or hose 21 so that the compressed air will build up in and pressurize chamber 14. Rather than a manually operated valve 87 in vacuum intake pipe connector 16, a one way valve could be provided in the connector which would allow flow of air and liquid into the chamber 14 during the vacuum cleaning process, but block flow of air and liquid out of chamber 14 through the vacuum intake pipe or hose 21. With chamber 14 pressurized, the user can then position the end 85 of hose 83 over or in the waste collecting drum or tank inlet and open valve 84 to allow the liquid from the chamber 14 to flow under pressure from hose 83 into the waste collecting drum or tank. The liquid flowing along the canister bottom 30 and out the bottom drain opening 64 carries with it any debris or sludge that has built up on the canister bottom.

When canister internal collecting chamber 14 is to be pressurized as described above, a pressure relief valve 88 should be provided in communication with the top of chamber 14 as a precaution to release any dangerous high pressure build up in chamber 14.

Excellent cleanup of spilled liquids, such as oil, on a floor has been achieved by first sucking up the spilled liquid, then applying an appropriate degreaser, detergent, or soap to the area, using the scrub brush 89, FIGS. 1, 2, and 9, on the cleaning attachment 24 to scrub the degreaser, detergent, or soap into any liquid residue remaining on the floor, and then sucking up the degreaser, detergent, or soap with the liquid residue to remove the residue from the floor. While containers of the degreaser, detergent, soap, or other cleaning agents, preferably with sprayers attached, can be kept easily accessible in storage pan 38, it has been found convenient to provide a storage tank for such degreaser, detergent, soap, or other cleaning agent attached to the vacuum cleaner and arranged to be pressurized and having a sprayer to easily spray the area to be cleaned up. Thus, as shown in FIG. 9, auxiliary tank 90 is mounted on the side of canister 40 such as by bands 91 and has hose 92 extending therefrom. A valve and spray nozzle 93 is attached to the end of hose 92 which can be operated by a user by pushing valve button 94 to spray a degreaser, detergent, soap, or other cleaning agent from auxiliary tank 90 onto a surface to be cleaned. Tank top 95 is removable to allow the tank to be filled with degreaser, detergent, soap, or other cleaning agent. The top portion of auxiliary tank 90 is connected through the top of canister 40 to communicate with chamber 14 by pipe 96 with appropriate fittings. A valve 97 opens auxiliary tank 90 to communication with chamber 14. When chamber 14 is pressurized as previously explained, valve 97 can be opened to also pressurize auxiliary tank 90. With auxiliary tank 90 pressurized, valve 97 is closed to allow operation of the vacuum cleaner without depressurizing tank 90. Auxiliary tank 90 could also be pressurized directly from the compressed air source.

While auxiliary tank 90 is shown secured to the outside of the canister, it could be located inside the canister with an inlet opening directly to outside the canister for filling the auxiliary tank. The auxiliary tank will still have means for pressurizing it such as a valved connection to the canister internal chamber 14 as described above. It has been found that an auxiliary tank with a capacity of one gallon is satisfactory.

The vacuum cleaner of the invention can also be used to actually drain compartments of equipment being worked on. Thus, the cleaning attachment 24 can be interchanged with an attachment configured to fit into an engine oil compartment to suck out oil to be changed, into a transmission to suck out transmission fluid to be changed, attached to a cooling system hose to suck out coolant, or into other compartments or sources of fluid. The vacuum cleaner of the invention can be used in various industrial or other locations, particularly where fluids have to be removed from equipment containers or reservoirs or where liquid spills have to be cleaned up.

The vacuum cleaner of the invention can be made in various sizes. For the vacuum cleaner embodiments shown, a canister size giving a collection capacity between about ten and fifteen gallons has been found satisfactory. Further, wheels of about eight inch diameter have been found to allow a user to easily move the vacuum cleaner when filled with liquid. Building the vacuum cleaner to have about a six inch clearance between the floor and the bottom of the canister has also been found satisfactory and with a fifteen gallon canister substantially filled with liquid, provides a center of gravity to make it easy for a user to tip and move the vacuum cleaner.

While the vacuum cleaner of the invention has been described as well suited for use in vehicle or other equipment service facilities for clean up of liquid spills, it should be apparent that it can be used in any setting where liquid is to be cleaned up, such as for water clean up, or where liquids are to be removed from equipment or other compartments.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

The invention claimed is:

1. A vacuum cleaning device powered by compressed air, comprising:

a canister forming an internal chamber having a top and a bottom;

a venturi and nozzle assembly in fluid flow communication with the internal chamber and adapted to be connected to a source of compressed air whereby compressed air is directed from the nozzle through the venturi to create a vacuum in the internal chamber and having an outlet for air passing through the venturi;

a vacuum intake pipe connected in fluid flow communication with the internal chamber;

a drain opening at the bottom of the chamber for draining liquid and debris from the chamber;

means for closing the drain opening to prevent liquid and debris in the chamber from draining through the drain opening and for opening the drain opening when desired to drain liquid and debris from the chamber; and an auxiliary tank for holding a cleaning agent, means for pressurizing the auxiliary tank, a hose extending from the auxiliary tank, and a nozzle and valve assembly on the hose for spraying cleaning agent from the auxiliary tank.

2. A vacuum cleaning device powered by compressed air according to claim 1, wherein the bottom of the chamber is sloped toward the drain opening.

3. A vacuum cleaning device according to claim 2, wherein the drain opening is centered in the bottom of the chamber.

4. A vacuum cleaning device powered by compressed air according to claim 1, additionally including an indicator to indicate when the chamber is filled with liquid.

5. A vacuum cleaning device powered by compressed air according to claim 4, wherein the indicator allows a user to see the level of the liquid in the chamber.

6. A vacuum cleaning device powered by compressed air according to claim 1, additionally including a valve to prevent liquid from entering the venturi and nozzle assembly when the chamber fills with liquid.

7. A vacuum cleaning device powered by compressed air according to claim 1, additionally including wheels and a handle so that the vacuum cleaner can be easily moved to desired locations for use.

8. A vacuum cleaning device powered by compressed air according to claim 7, wherein the vacuum cleaning device has two wheels and two legs without wheels, and wherein the handle is positioned to enable a user to tip the vacuum cleaner device onto the two wheels to easily move the device.

9. A vacuum cleaning device powered by compressed air according to claim 1, additionally including a cleaning attachment secured to the vacuum intake pipe wherein the cleaning attachment is adapted to slide across a floor to vacuum up a liquid on the floor and includes a brush thereon for brushing the floor.

10. A vacuum cleaning device powered by compressed air according to claim 9, additionally including a clip for holding the vacuum intake pipe when the cleaning attachment is held in the drip tray.

11. A vacuum cleaning device powered by compressed air according to claim 1, additionally including a storage tray for holding supplies.

12. A vacuum cleaning device according to claim 1, wherein the means for closing the drain opening to prevent liquid and debris in the chamber from draining through the drain opening and for opening the drain opening when desired to drain liquid and debris from the chamber is a plug mounted on a shaft and biased into the opening to close it, the shaft and plug being moved by a user against the bias and out of position closing the drain to open the drain.

13. A vacuum cleaning device powered by compressed air, comprising:

a canister forming an internal chamber having a top and a bottom;

a venturi and nozzle assembly in fluid flow communication with the internal chamber and adapted to be connected to a source of compressed air whereby compressed air is directed from the nozzle through the venturi to create a vacuum in the internal chamber and having an outlet for air passing through the venturi;

a vacuum intake pipe connected in fluid flow communication with the internal chamber;

a drain opening at the bottom of the chamber for draining liquid and debris from the chamber;

means for closing the drain opening to prevent liquid and debris in the chamber from draining through the drain opening and for opening the drain opening when desired to drain liquid and debris from the chamber; and means for pressurizing the internal chamber to force material collected in the chamber out of the chamber through the drain opening when desired to drain liquid and debris from the chamber.

14. A vacuum cleaning device powered by compressed air according to claim 13, wherein the means for pressurizing the internal chamber includes means for directing compressed air into the chamber rather than through the venturi.

15. A vacuum cleaning device powered by compressed air according to claim 14, wherein the means for directing compressed air into the chamber rather than through the venturi includes a valve for closing the outlet for air passing through the venturi to thereby block flow of air through the venturi.

16. A vacuum cleaning device powered by compressed air according to claim 15, wherein the means for pressurizing the internal chamber also includes a valve for closing the vacuum intake pipe.

17. A vacuum cleaning device powered by compressed air according to claim 13, additionally including a length of hose in communication with the drain opening, and wherein the means for closing the drain opening to prevent liquid and debris in the chamber from draining through the drain opening and for opening the drain opening when desired to drain liquid and debris from the chamber includes a valve secured in the hose.

18. A vacuum cleaning device powered by compressed air according to claim 13, wherein the bottom of the chamber is sloped toward the drain opening.

19. A vacuum cleaning device according to claim 18, wherein the drain opening is centered in the bottom of the chamber.

20. A vacuum cleaning device powered by compressed air according to claim 13, additionally including an indicator to indicate when the chamber is filled with liquid.

21. A vacuum cleaning device powered by compressed air according to claim 20, wherein the indicator allows a user to see the level of the liquid in the chamber.

22. A vacuum cleaning device powered by compressed air according to claim 13, additionally including a valve to prevent liquid from entering the venturi and nozzle assembly when the chamber fills with liquid.

23. A vacuum cleaning device powered by compressed air according to claim 13, additionally including wheels and a handle so that the vacuum cleaner can be easily moved to desired locations for use.

24. A vacuum cleaning device powered by compressed air according to claim 23, wherein the vacuum cleaning device has two wheels and two legs without wheels, and wherein the handle is positioned to enable a user to tip the vacuum cleaning device onto the two wheels to easily move the device.

25. A vacuum cleaning device powered by compressed air according to claim 13 additionally including a cleaning attachment secured to the vacuum intake pipe wherein the cleaning attachment is adapted to slide across a floor to vacuum up a liquid on the floor and includes a brush thereon for brushing the floor.

26. A vacuum cleaning device powered by compressed air according to claim 25, additionally including a drip tray for holding the cleaning attachment when not in use.

27. A vacuum cleaning device powered by compressed air according to claim 26, additionally including a clip for holding the vacuum intake pipe when the cleaning attachment is held in the drip tray.

28. A vacuum cleaning device powered by compressed air according to claim 13, additionally including a storage tray for holding supplies.

29. A vacuum cleaning device powered by compressed air according to claim 13, additionally including an auxiliary tank for holding a cleaning agent, means for pressurizing the auxiliary tank, a hose extending from the auxiliary tank, and a nozzle and valve assembly on the hose for spraying cleaning agent from the auxiliary tank.

* * * * *